US006543727B2

(12) United States Patent
Click et al.

(10) Patent No.: US 6,543,727 B2
(45) Date of Patent: Apr. 8, 2003

(54) ASSIST ROD AND BASKET ASSEMBLY

(75) Inventors: Gary Click, Birmingham, AL (US); Cory O'Brien, Coquitlam (CA)

(73) Assignee: VAE Nortrak North America Inc., Cheyenne, WY (US)

( * ) Notice: Subject to any disclaimer, the term of this patent is extended or adjusted under 35 U.S.C. 154(b) by 0 days.

(21) Appl. No.: 09/944,748

(22) Filed: Aug. 31, 2001

(65) Prior Publication Data

US 2003/0042370 A1 Mar. 6, 2003

(51) Int. Cl.[7] ..... E01B 7/00
(52) U.S. Cl. ..... 246/452; 246/435 R
(58) Field of Search ..... 246/449, 450, 246/451, 452, 435 R, 440

(56) References Cited

U.S. PATENT DOCUMENTS

| | | | | | |
|---|---|---|---|---|---|
| 803,093 | A | * | 10/1905 | Cellner | 246/450 |
| 1,802,406 | A | * | 4/1931 | Dale | 246/291 |
| 2,009,269 | A | * | 7/1935 | Lundy | 246/253 |
| 2,208,449 | A | * | 7/1940 | Bone | 246/452 |
| 2,222,855 | A | * | 11/1940 | Ritchey | 246/452 |
| 2,380,145 | A | * | 7/1945 | Bone | 246/291 |
| 2,397,427 | A | * | 3/1946 | Morris | 246/452 |
| 2,772,844 | A | * | 12/1956 | McGowan | 246/318 |
| 4,637,579 | A | * | 1/1987 | Hartung | 246/404 |
| 5,527,005 | A | * | 6/1996 | Wydotis | 246/404 |
| 5,620,156 | A | * | 4/1997 | Berggren et al. | 246/221 |
| 6,158,698 | A | * | 12/2000 | Click et al. | 238/62 |
| 6,290,189 | B1 | * | 9/2001 | Heim | 246/449 |

OTHER PUBLICATIONS

"J" Manufacturing Switch Layout Southern Pacific Standard figure (no date).
Nortrak Bill of Material figure (no date ).

* cited by examiner

*Primary Examiner*—Mark T. Le
(74) *Attorney, Agent, or Firm*—Glenn Patent Group; Michael A. Glenn

(57) ABSTRACT

A railroad switch assembly comprises a basket that directly actuates a torsional assist rod. The basket is located at a lower elevation than the assist rod, preferably in a hollow tie and preferably between the switch machine and the running rail.

14 Claims, 12 Drawing Sheets

ASSIST ROD AND BASKET ASSEMBLY

TECHNICAL FIELD OF THE INVENTION

This invention relates to assist rod and basket assemblies for throwing railway switch points.

BACKGROUND OF THE INVENTION

Railway switches generally include a switch machine mounted on the outside of the rails adjacent the turnout points. The switch machine actuates a throw rod that is connected to a switch rod extending between the switch points.

A lost motion device, commonly referred to as a basket, may be provided between the throw rod and the switch rods to take up some of the motion of the throw rod before transmitting it to the switch rods. The basket enables a signal maintainer to adjust both the initial position and the throw of the switch rod to account for differing design applications of the rods and the total linkage length of the rod and to compensate for differing design locations of the switch machine in relation to the switch point.

In order to ensure coordinated movement between the point and heel ends of the movable rails, assist rods are used with longer switch points. For convenience the point and heel ends of the assembly are referred to as the front and rear ends respectively. The assist rods act to transfer force from the front end switch rods to those at the rear end. Operating or throw rods extend from the switch rods to the assist rod. The assist rod extends along the outside of the running rail, but on the side of the tracks opposite to the switch machine. This is done to accommodate the clearance requirements between switch accessories and the rail (to allow for tamping and protection from dragging equipment on passing trains). Juxtaposing the switch machine and the assist rod would require unusually long ties to maintain the necessary clearance.

In a typical arrangement, the throw rod is connected to the switch rods by means of a basket. The switch rods are in turn connected to the switch point (rails). The switch rods are also connected to a connector rod that extends under the running rail to a crank stand located on the outside of the running rail. The crank stand includes a lever, one end of which is connected to the connector rod and the other end of which is connected to an elongated assist rod running parallel to the running rail. The lever is mounted on a hinge on the crank stand such that when the connector rod causes one end of the lever to rotate about the hinge, the other end causes axial displacement of the assist rod. The assist rod is attached at its rear end to a similar lever and crank stand assembly that is in turn connected to a connector rod. The rear end connector rod is connected to a basket which transfers movement of the connector rod to the rear end switch rods.

It has also been proposed to used a torsional assist rod mounted on the side of the track that is distal from the switch machine. The assist rod is connected by a pin to the end of the switch rod or to the end of a connector rod. Displacement of the front end switch rod causes the assist rod to rotate. By a similar arrangement at the rear end, rotation of the assist rod throws a connector rod connected to the rear end switch rod. It is also known to locate torsional assist rods between the rails.

One disadvantage of prior art assist rod assemblies is that the basket is located between the rails to allow for tamping on the outside of the rails. However, the location of the baskets between the rails results in limited accessibility due to hot air ducts used for snow removal that are frequently mounted between the rails over the top of the basket. In addition, the signal maintainer must place himself in the direct path of oncoming rail traffic to service or adjust the device.

In addition, the switch ties must accommodate both a switch machine (on one end) and an assist rod and its associated linkage components (on the other end). As a result, relatively long ties (typically 14 feet long) are needed. In the case of crowded rail yards, the loss of space resulting from adjacent switches becomes critical.

It is an object of the present invention to provide an improved assist rod assembly that overcomes the foregoing deficiencies.

SUMMARY OF THE INVENTION

The invention provides an assist rod and basket assembly. The summary herein provides a general overview of the preferred embodiment and is not intended to define essential features of any aspect of the invention.

The front and rear baskets of the invention play a dual role. They both take up lost motion and they actuate the assist rod.

The front basket includes an upwardly extending head portion adapted to link to a torsional assist rod and to rotate the assist rod when the basket undergoes lateral movement (transverse to the running rails) as a result of the switch being thrown. An elongated hinge connection allows the basket to be restricted to substantially lateral displacement while causing rotation of link arms attached to the assist rod.

The head of the basket comprises a bore for receiving a pin for rotation in the bore. A pair of link arms extend from the ends of the pin. The link arms engage the assist rod or an assist rod assembly to cause it to rotate when the basket undergoes lateral movement transverse to the assist rod. The assist rod or a portion of the assist rod assembly is separately mounted for rotation in a sleeve on a support clip. The basket comprises an internal structure similar to prior art structures. A threaded connector rod slidably extends through the basket. Movement of the basket in relation to the connector rod is limited by nuts threaded onto the rod at each end of the basket. Adjustement of the nuts serves to adjust the amount of lost motion to be taken up by the basket before actuating the connector rod by abutment of the basket with the nuts.

The rear basket comprises two link arms, one end of which arms engage the assist rod. The other ends are rotatably mounted on pins extending from opposed sides of a slide block sandwiched between the ends of the link arms. A threaded connector rod is slidably received in the slide block. Nuts are disposed on the connector rod at each side of the slide block so as to enable adjustment of the amount of free motion that the basket will be allowed to undergo before actuating displacement of the connector rod by abutment of the basket to the nuts.

The baskets are at least partially housed in hollow ties which also house rodding associated with the switch. This avoids interference of the baskets with tamping, even when the baskets are located on the outside of the running rail.

The invention allows for a more compact switch assembly in which the baskets and the assist rod may be located, in the preferred embodiment, on the same side of the rails as the switch machine. This in turn allows for the use of shorter ties. The invention also has the advantage of comprising a smaller number of components than the assist rod assemblies of the prior art.

In one aspect the invention is a railroad switch assembly comprising point and heel end switch rods (or switch rod assemblies) housed in hollow ties, and a front basket that is at least partially housed in the point end hollow tie and that is connected to the assist rod to directly actuate movement of the assist rod when the basked is displaced.

In another aspect, the front basket is located between the switch machine and the running rail adjacent the switch machine.

Lateral displacement of the front basket causes rotation of the assist rod.

The front basket is operatively connected to the assist rod by at least one torsion arm extending between the assist rod and the front basket.

In another aspect, the invention is a railroad switch assembly comprising a switch machine, a throw rod actuated by the switch machine, a front basket for adjusting the throw applied by the throw rod to a point end switch rod or switch rod assembly, and wherein the front basket directly actuates rotation of a torsional assist rod or rod assembly. In more specific aspects of the invention, displacement of the front basket is substantially lateral, the point end switch rod assembly is housed in a hollow tie, and the front basket is at least partially housed in the hollow tie.

In another aspect, the invention is a railroad switch assembly comprising a switch machine, a throw rod actuated by the switch machine, and a front basket for located between the switch machine and a running rail proximal to the switch machine.

Other aspects of the invention relate to the structure of the front and rear baskets and basket assemblies as disclosed herein.

These and further aspects of the invention will be appreciated by reference to the detailed description of the preferred embodiment and are defined by the claims that follow.

DETAILED DESCRIPTION OF THE PREFERRED EMBODIMENT OF THE INVENTION

Figure 1:
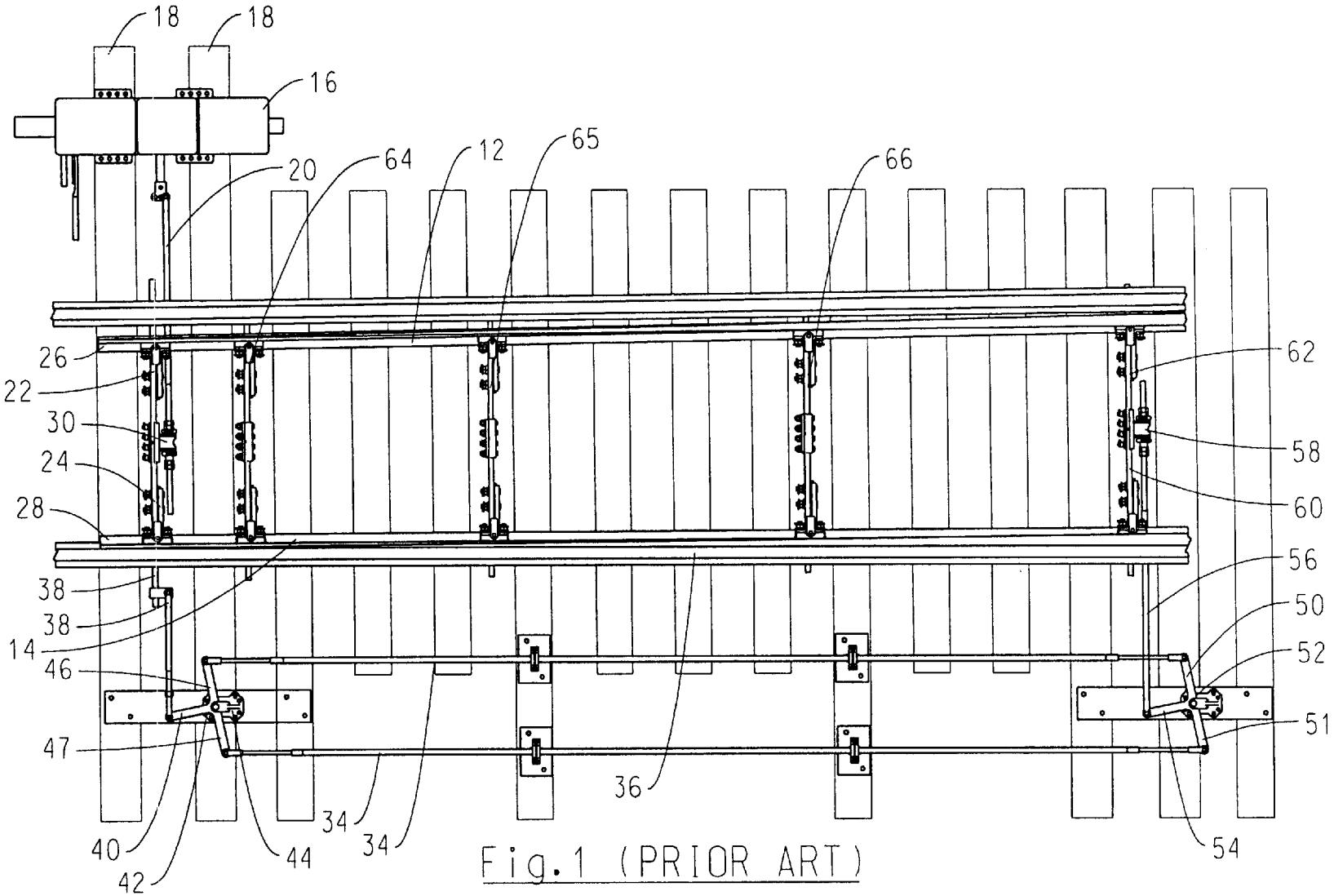
Fig. 1 (PRIOR ART)
FIG. 1 is a layout drawing (plan view) of a prior art switch and associated assist rod assembly.

FIG. 1 illustrates a fairly typical prior art switch layout in which the assist rod and basket assembly is shown. The switch is used to throw the switch point (rails 12, 14).

A switch machine 16 is mounted on the outside of the rails on a switch stand plate attached to the ends of elongated ties 18. Switch machine 16 actuates a throw rod 20 that is connected to a pair of switch rods 22, 24 connected end to end and extending between the points 26, 28 of the switch point rails.

A front basket 30 is disposed between the throw rod 20 and the switch rods 22, 24. As is known, the basket 30 is adapted to slide a predetermined amount along the throw rod 20 before the basket will engage so as to actuate movement of the switch rods. As will be appreciated by reference to FIG. 2, the predetermined amount may be adjusted in the field by displacing basket nuts 31, 33 that are engaged on a threaded portion of the throw rod 20.

The switch may also include ancillary rodding that may include a detector rod, a lock rod and the like, none of which is illustrated in FIG. 1.

In order to ensure coordinated movement between the front (point) and rear (heel) ends of the switch point, assist rods 34 extend along the outside of the running rail 36 on the side of the tracks opposite to the switch machine 16. One or more connector rods 38 extend parallel to the switch rods and under the running rail 36. One end of connector rod 38 is attached to switch rod 24 while the other end is connected to a one arm 40 of a lever 42 that is hinged to a crank stand 44 located on the outside of the running rail 36.

Second and third arms 46, 47 of the lever are hinged to elongated assist rod 34 running parallel to the running rail 36. When the connector rod 38 causes arm 40 of the lever to rotate about the hinge, the other arms 46, 47 cause axial displacement of the assist rods 34. The assist rods 34 are hinged at their rear end to arms 50, 51 of a similar lever 52. Arm 54 of lever 52 is in turn hinged to a connector rod 56. Connector rod 56 is connected to a rear basket 58 which transfers movement of the connector rod to the rear end switch rods. Rear basket 58 is also a lost motion basket and is attached to rear switch rods 60, 62 that are in turn attached to the heel end of the switch point rails 12, 14.

Additional passive connector rods 64, 65, 66 may be provided intermediate the front and rear end rods in order to coordinate the movement of the opposed movable rails.

Figure 2:
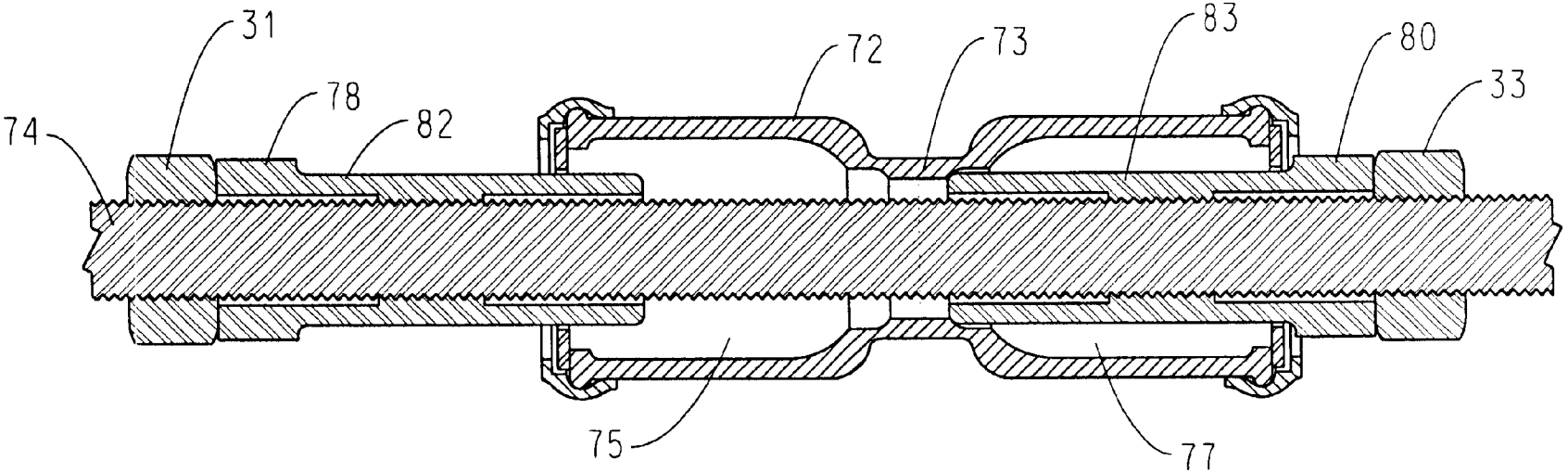
Fig. 2 (PRIOR ART)
FIG. 2 is a longitudinal cross-section of a prior art basket assembly.

A typical basket assembly according to the prior art is shown in FIG. 2. Housing 72 includes a passageway so as to accommodate a threaded throw rod 74 therethrough. Conical nuts 78, 80 are disposed on the threaded rod such that the extended portions 82, 83 of the nuts extend into the housing 72 and provide a bearing surface for axial displacement of the housing. The housing 72 includes a neck portion 73 located medially of the housing. Neck 73 is of such a diameter to allow passage of the throw rod 74 but not of the extended portions 82 of the nuts. The length of the portions 82 is greater than the depth of the opposed recesses 75, 77 of the housing. As a result, relative movement between the nut and the housing is limited by abutment of the nut against the neck 73. It will be appreciated that movement between one of the nuts and the housing may therefore take place before the nut will abut the neck of the housing and force the housing to displace.

Figure 3:
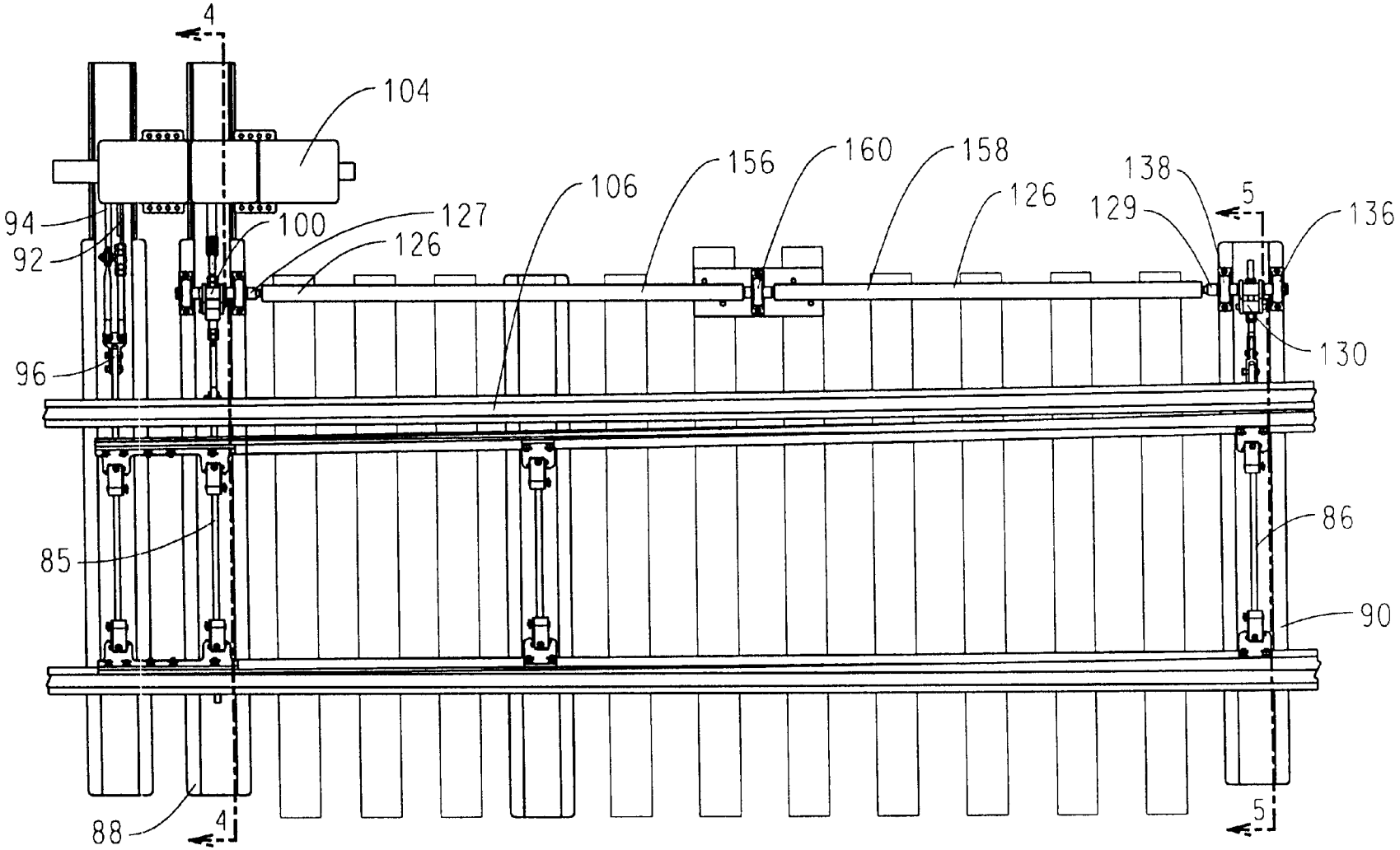
FIG. 3 is a layout drawing (plan view) of the assist rod assembly according to the preferred embodiment of the invention.

Referring now to FIG. 3, the preferred embodiment of the invention finds application where the front and rear switch rods 84 and 86 are housed within hollow ties 88, 90. A "hollow tie" as referred to herein and in the art refers to a substantially three sided channel with an open upper end and having the approximate width and depth of a railroad tie. Such hollow ties are typically made of metal. Additional rodding, such as a lock rod 92, a detector rod 94 and a rod 96 for use in conjunction with the lock rod and the detector rod, will typically also be housed within a hollow tie.

Figure 4:
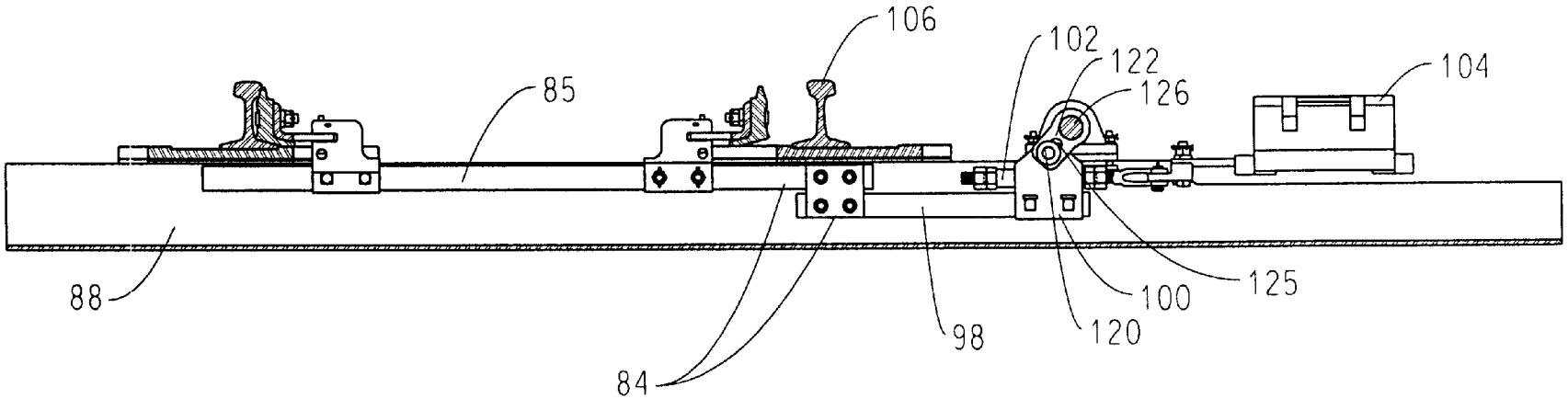
FIG. 4 is a side elevation of the front end basket assembly taken along line 4—4 of FIG. 3.

Referring to FIG. 4, a switch rod assembly 84 comprises switch rod 85 which is connected to another rod 98, herein referred to as a "connector basket rod", which is also housed within hollow tie 88. Although the switch rod assembly of the preferred embodiment includes a switch rod and a connector basket rod, it will be appreciated that the switch rod assembly may consist of a single switch rod.

Connector basket rod 98 is attached to front basket 100 through which extends throw rod 102. Throw rod 102 is attached to the throw bar of the switch machine 104.

Figure 6:
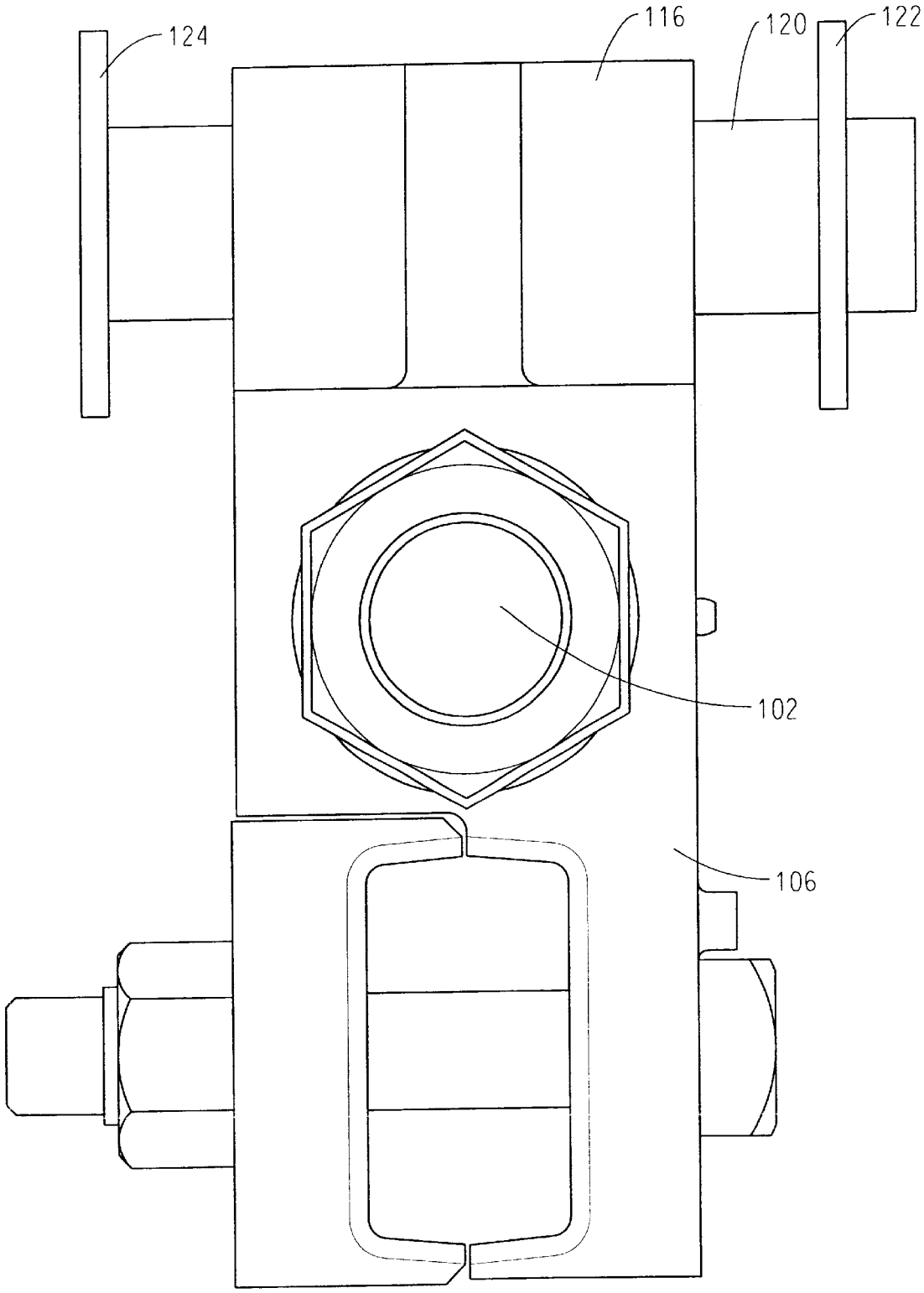
FIG. 6 is an end view of the front basket assembly according to the preferred embodiment but not including the assist rod.
Figure 7:
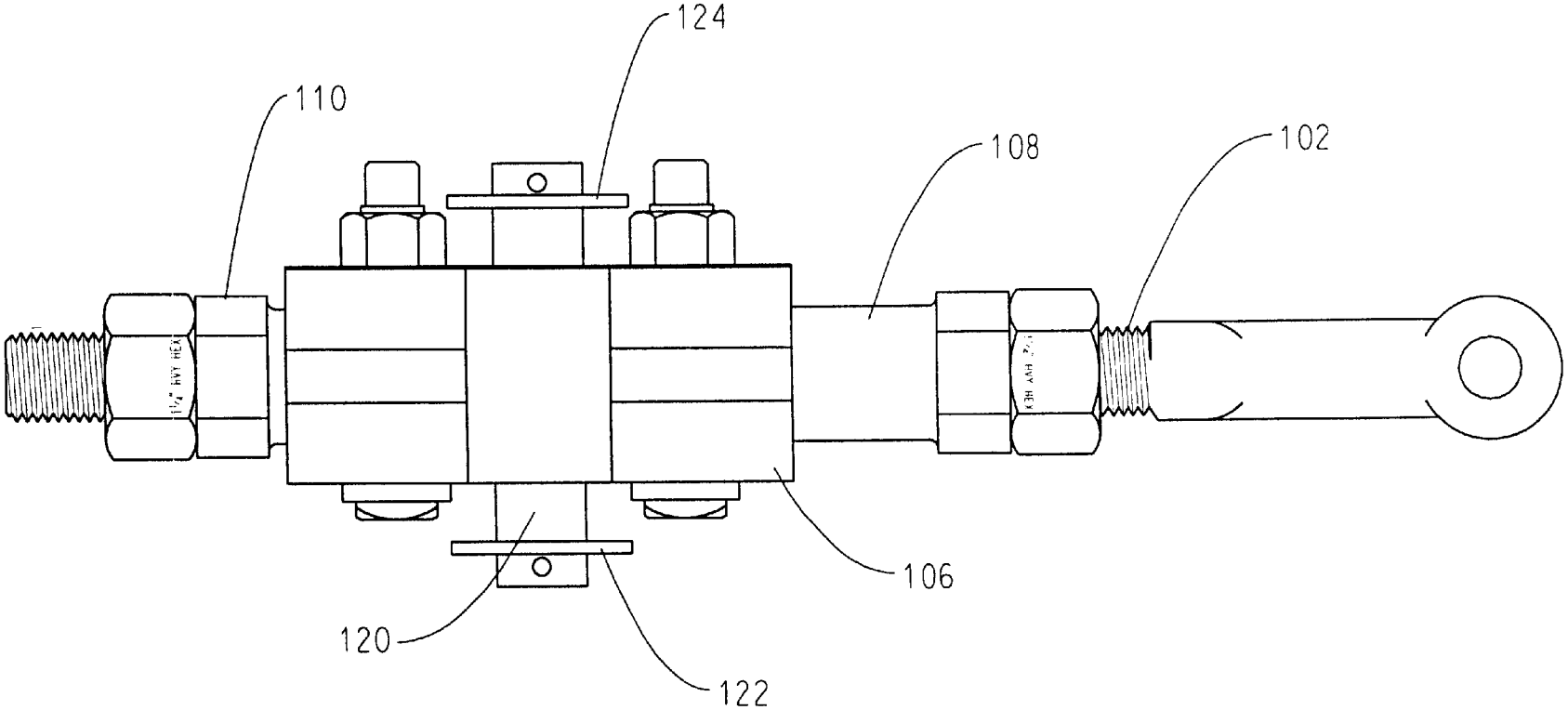
FIG. 7 is a plan view of the front basket assembly without the assist rod.
Figure 8:
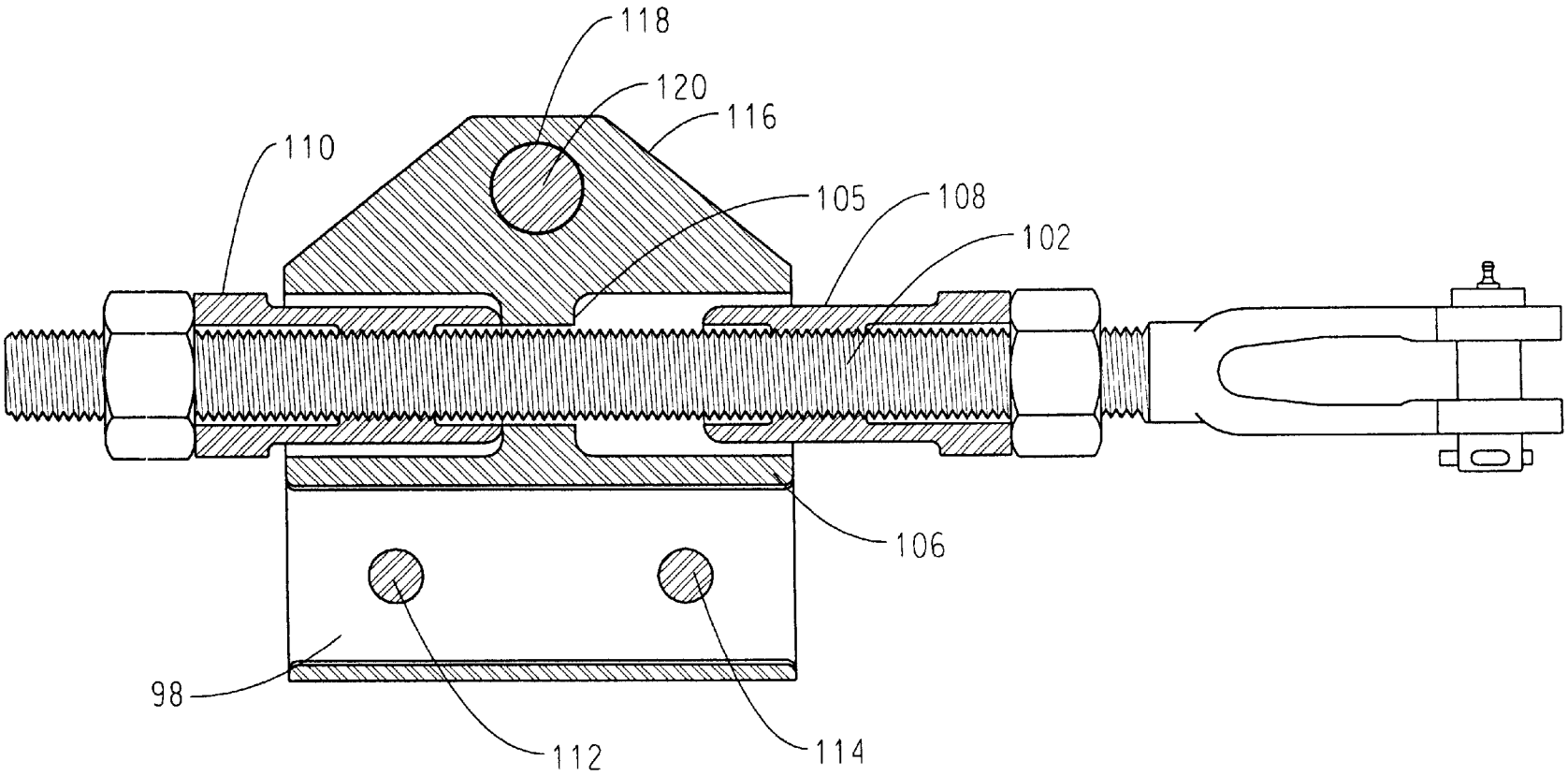
FIG. 8 is a cross-section of the front basket assembly.

Front basket 100 is illustrated in detail in FIGS. 6, 7 and 8. Housing 106 includes a passageway enabling the passage therethrough of throw rod 102. The portion of throw rod 102 in the vicinity of basket 100 is threaded to receive elongated "conical" nuts 108, 110. Connector basket rod 98 is attached to the housing by bolts 112, 114. Movement of the basket 100 in relation to the throw rod 102 is limited by the position of the nuts 108, 110 threaded onto the throw rod at each end of the basket. Adjustment of the position of the nuts serves to adjust the amount of lost motion to be taken up by the basket before actuating the throw rod by abutment of the neck 105 of the basket with the ends of the nuts.

The basket housing 106 includes an upwardly extending head 116 including a bore 118 for receiving a pin 120. Pin 120 extends out of each side of the bore 118 to accommodate the mounting of link arms 122, 124 (not shown in FIG. 8 but seen in FIG. 4). The opposite end of the link arms 122, 124 are rigidly associated with an assist rod 126. Link arms 122, 124 are in effect torsion arms for actuating rotation of the assist rod 126. In the preferred embodiment, link arms 122, 124 are rigidly connected to a transfer rod 127 which is in turn connected end to end with assist rod 126. In some embodiments, transfer rod 127 can be dispensed with in favour of an assist rod that extends to connect directly to the link arms 122, 124.

Figure 9:
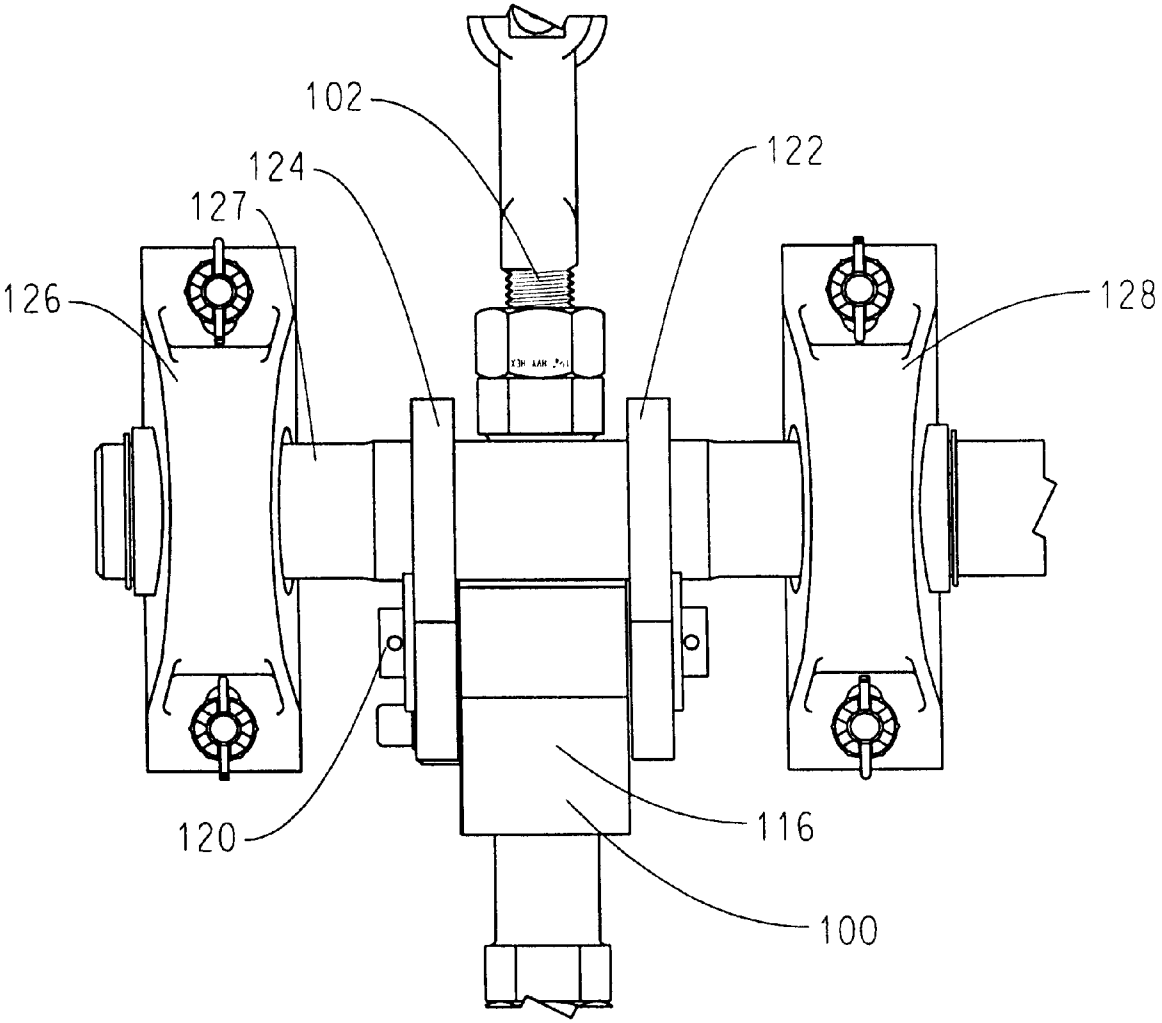
FIG. 9 is a plan view of the front basket and assist rod assembly.
Figure 10:
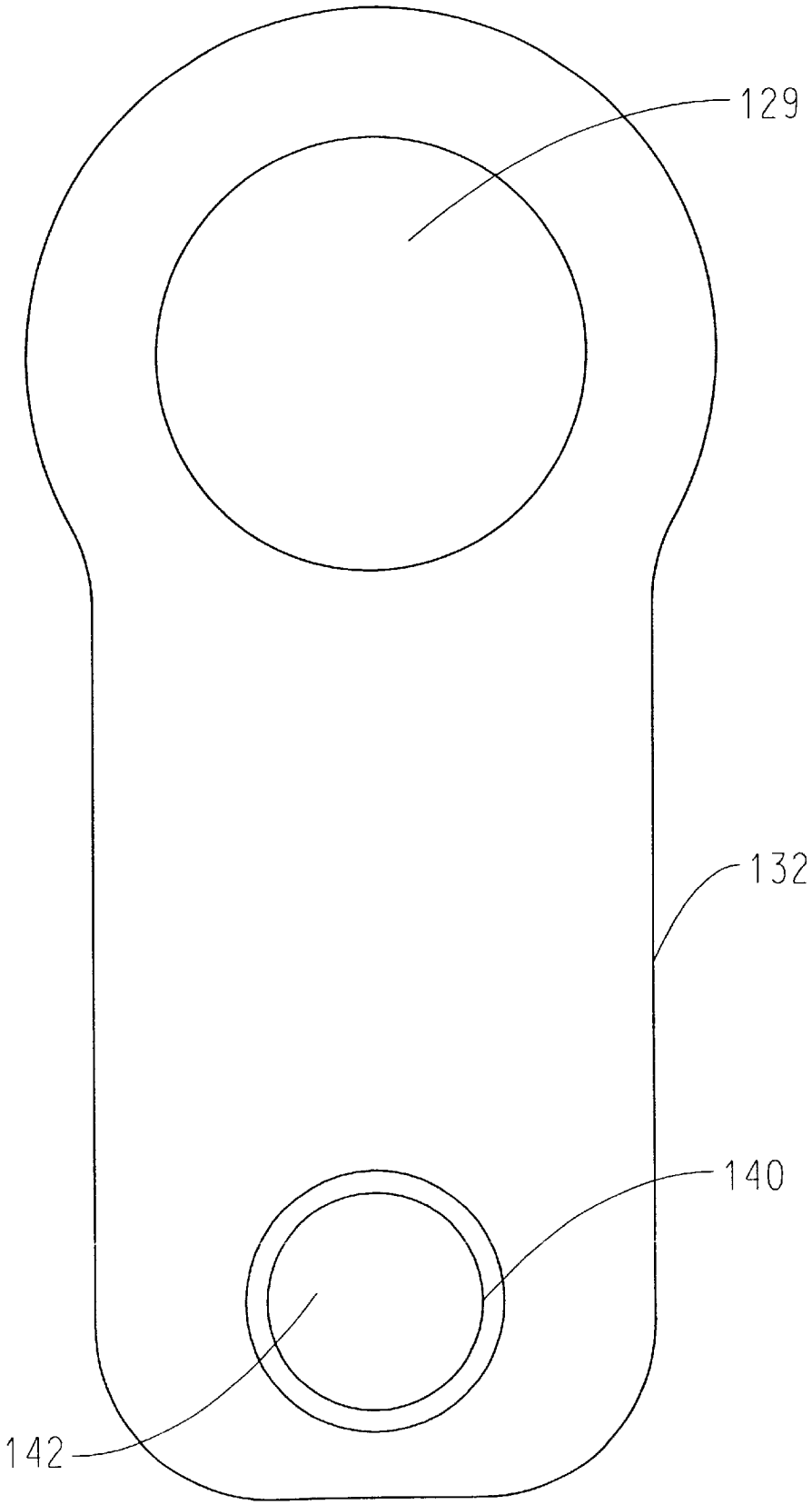
FIG. 10 is a side elevation of the rear basket.
Figure 11:
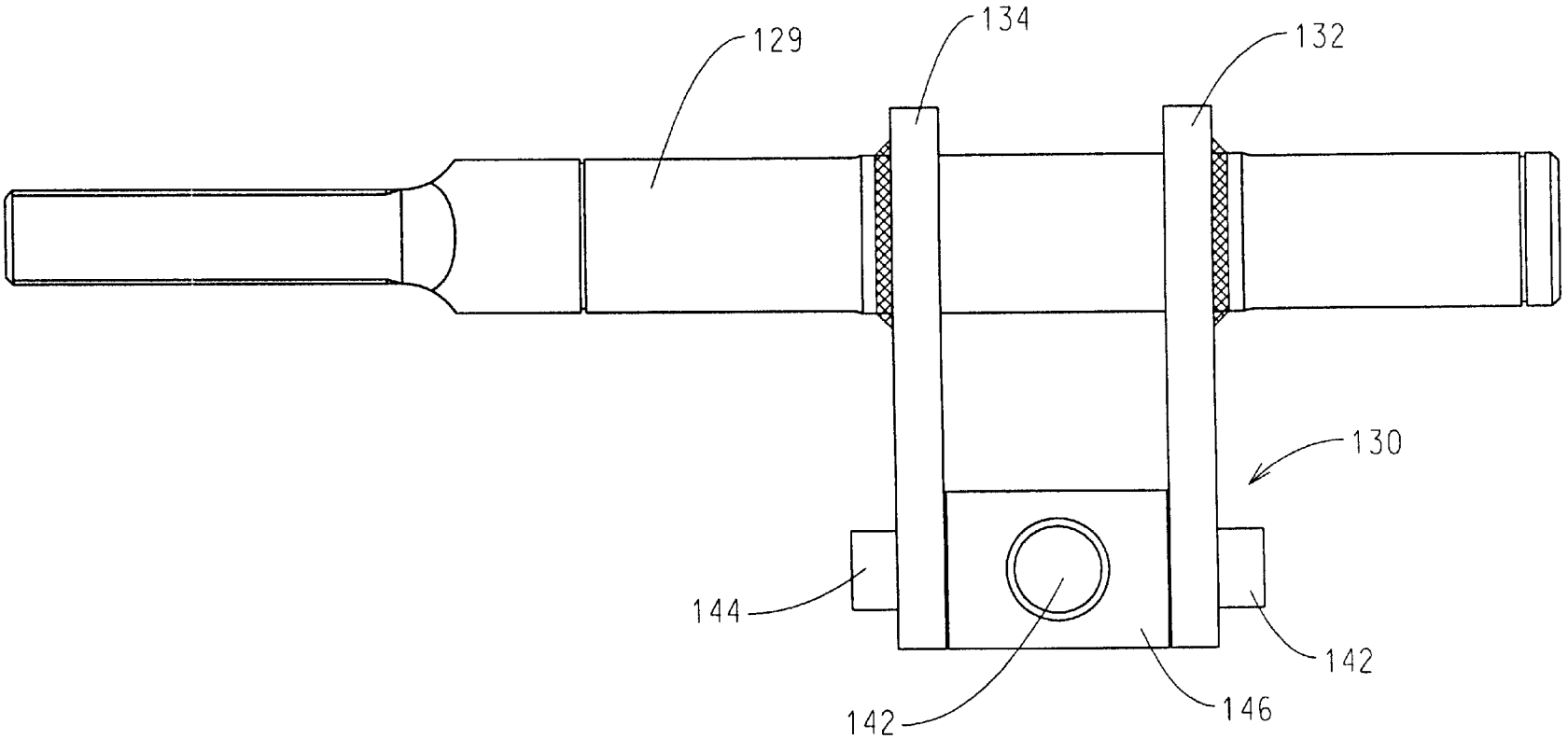
FIG. 11 is an end view of the rear basket and assist rod assembly.
Figure 12:
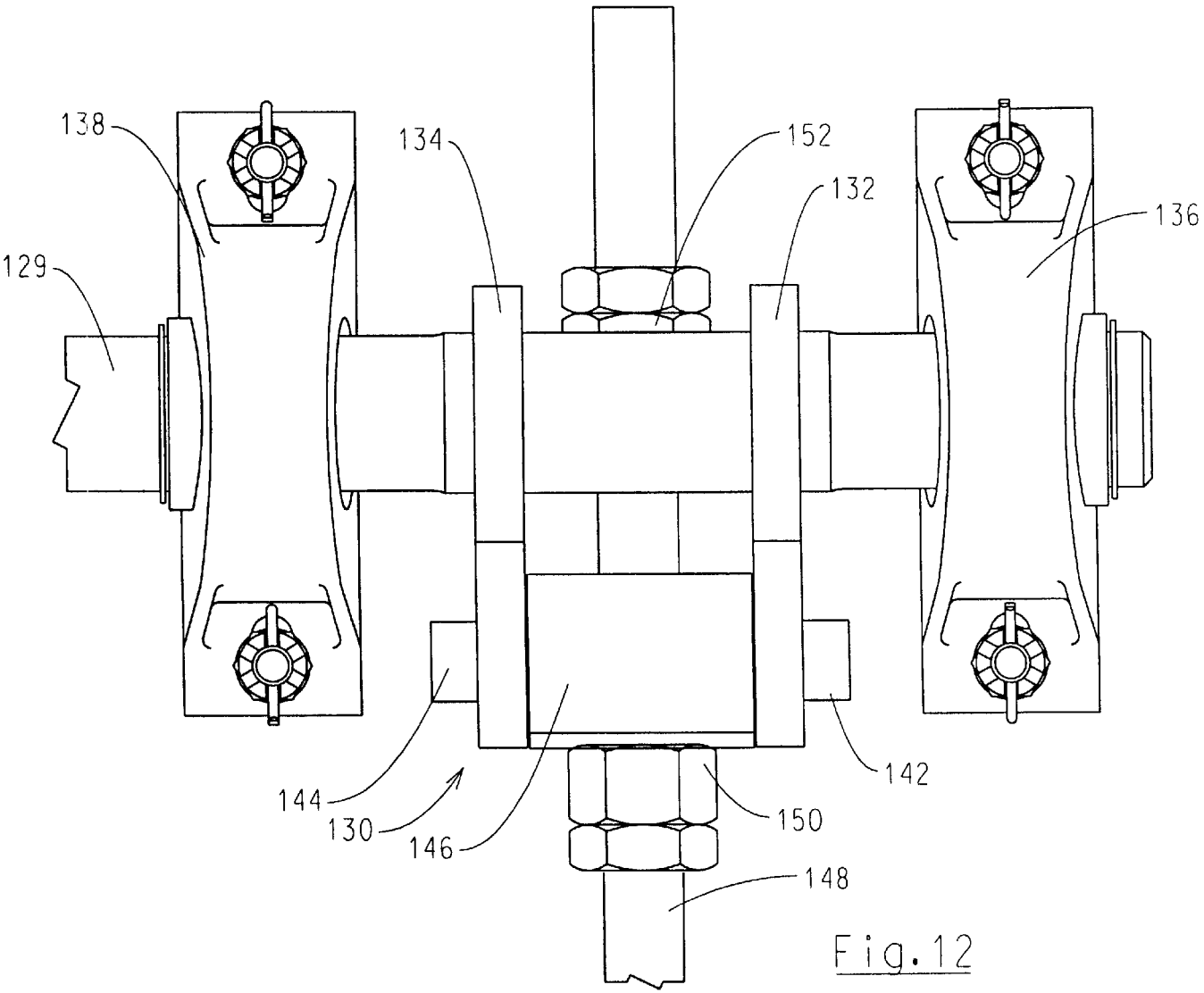
FIG. 12 is a plan view of the rear basket and assist rod assembly.

Assist rod 126 extends parallel to the rails but between the switch machine 104 and the proximal fixed rail 106. The assist rod 126 is preferably cylindrical along its length but it will be appreciated that it need not necessarily be so. Appropriate adapters may be used between the link arms and the assist rod to cause the assist rod to rotate in the event a non-cylindrical assist rod is used. Referring to FIG. 9, the transfer rod 127 is supported for rotation within support clips 166,168 located adjacent each side of the front basket 100. Link arms 122 and 124 are provided with an elongated slot 125 (partially visible in FIG. 4) through which pin 120 is engaged.

It will be appreciated that when the basket undergoes lateral movement (transverse to the fixed rails) as a result of the switch being thrown, the link arms 122, 124 will cause the transfer rod 127 (and therefore the assist rod 126) to rotate. The elongated slot 125 accommodates the fact that, in the preferred embodiment, the pin will be translated in a straight horizontal direction while the link arms will rotate about the pin (the other end of the link arms not being free to displace vertically).

At the heel end of the switch, the rear basket 130 comprises two link arms 132, 134. An end of each of the link arms is rigidly associated with the assist rod 126, preferably by connection to a transfer rod 129 rigidly connected to the end of the assist rod 126. The assist rod 126 is supported for rotation in support clips 136, 138 adjacent each side of the rear basket. The ends of link arms 132, 134 that are opposite to the assist rod include bores 140 to receive two pins 142, 144 extending from opposite sides of the slide block 146. The slide block 146 is sandwiched between the link arms 132, 134 and a threaded connector rod 148 is slidably received in the slide block 146. Nuts 150, 152 are threaded on the connector rod at each side of the slide block 146 so as to enable adjustment of the amount of free motion that the basket 130 will undergo before actuating displacement of the connector rod 148 by abutment of the slide block 146 with the nuts 150, 152. The rear basket 130 is located on the outside of fixed rail 106.

Figure 5:
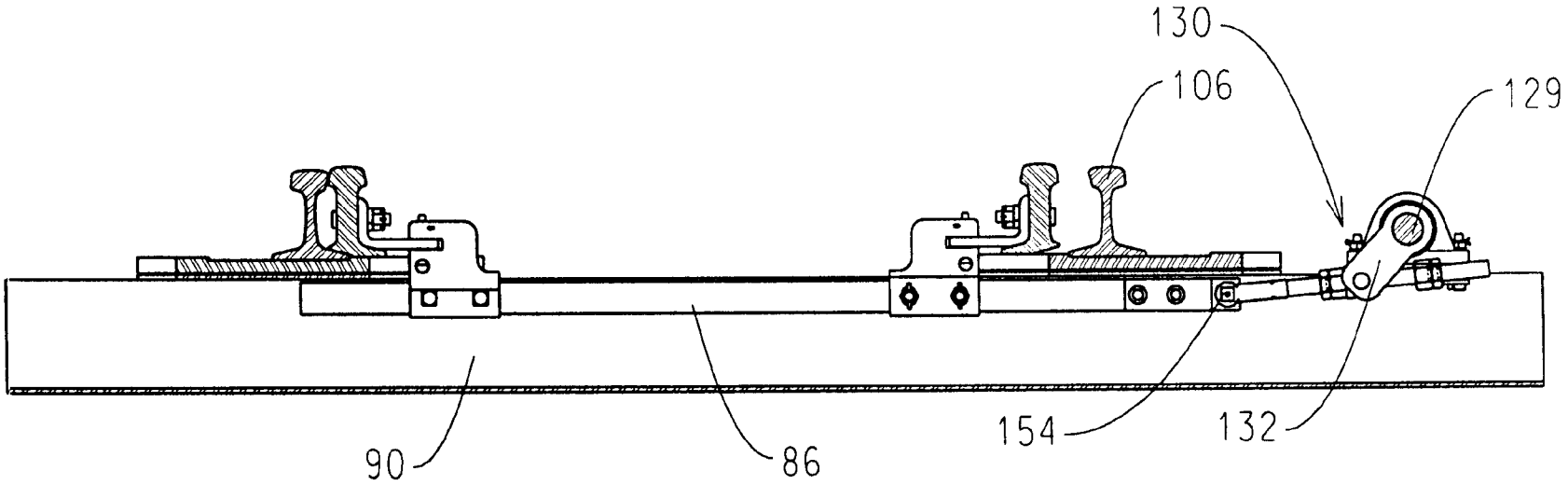
FIG. 5 is a side elevation of the rear end basket assembly taken along line 5—5 of FIG. 3.

At its distal end, connector rod 148 is hinged to the end of rear switch rod 86 as at 154 in FIG. 5. The connector rod 148 is housed within hollow tie 90. Rear basket 130 is partially housed within the hollow tie 90. Because link arms 132, 143 are both hinged about a single axis (e.g. they do not include the elongated slot found on the link arms of the front basket), the ends of the link arms which are distal from the assist rod undergo some displacement in the vertical plane when the assist rod is rotated. The hinged connection between the connector rod 148 and the rear switch rod 86 allows the basket end of the connector rod to displace in the vertical plane to accommodate such displacement of the basket.

In the preferred embodiment, the assist rod 126 is actually comprised of two rod segments 156, 158 that are operatively connected by means of a rotary drive connector bar 160. In this disclosure and in the claims, it will be understood that the reference to an assist rod includes any composite assist rod assembly wherein rotation of the assembly at the front (point) end causes the assembly to rotate at the rear (heel) end. Similarly any reference to a connection between part of the front or rear basket and the assist rod includes a connection to an intermediate element (such as the transfer rod of the preferred embodiment) which is in turn connected to an elongated assist rod.

Other variations to the preferred embodiment described herein may be practised without nonetheless departing from the scope of the invention.

What is claimed is:

1. A railroad switch assembly for switching a pair of movable rails in relation to at least one running rail, said running rail having a field side, each of said movable rails having a point end and a heel end, comprising:

a switch machine located on the field side of said running rail;

a point end switch rod connected to the point ends of said pair of movable rails, said point end switch rod being housed in a first hollow tie;

a heel end switch rod assembly connected to the heel ends of said pair of movable rails and comprising a heel end switch rod housed in a second hollow tie;

a front basket associated with said point end switch rod for controlling the throw applied to said point end switch rod said front basket being at least partially housed in a portion of said first hollow tie;

an assist rod assembly extending between said portion of said first hollow tie and said heel end switch rod assembly, said front basket being operatively connected to said assist rod assembly to actuate movement of said assist rod assembly upon displacement of said basket.

wherein said front basket is located between said switch machine and said running rail; and wherein said movement of said assist rod assembly is rotation.

2. The assembly of claim 1 wherein said displacement of said front basket is substantially lateral displacement.

3. The assembly of claim 2 wherein said front basket is operatively connected to said assist rod assembly by at least one torsion arm extending between said assist rod assembly and said front basket.

4. The assembly of claim 3 wherein a first end of said torsion arm is rigidly associated with said assist rod assembly and a second end of said torsion arm is non-rigidly retained on said front basket.

5. The assembly of claim 4 wherein said second end of said torsion arm comprises an elongated slot which slidably retains a pin extending through said front basket.

6. The assembly of claim 5 wherein said elongated slot is located at a lower elevation than said assist rod assembly.

7. The assembly of claim 4 wherein said second end of said torsion arm is hinged to said front basket.

8. The switch assembly according to claim 1 further comprising a rear basket associated with said heel end switch rod for controlling the throw applied to said heel end switch rod;

wherein said rear basket is at least partially housed within said second hollow tie and is connected to said assist rod assembly such that said assist rod assembly actuates movement of said rear basket;

and wherein said rear basket is adapted to slide along a connector rod having a hinged connection to said heel end switch rod.

9. A railroad switch assembly for switching a movable rail or point in relation to at least one running rail, said running rail having a field side, comprising:

a front basket operatively associated with a front switch rod assembly for controlling the throw applied to said front switch rod assembly;

a rear basket operatively associated with a rear switch rod assembly for controlling the throw applied to said rear switch rod assembly;

said front and rear baskets being at least partially housed within respective hollow ties and being located on said field side of said running rail; and, an assist rod assembly extending between said front basket and said rear basket, said assist rod assembly being rotatable by lateral displacement of said front basket.

10. A railroad switch assembly for switching a pair of movable rails in relation to at least one running rail, said running rail having a field side and a gauge side, each of said movable rails having a point end and a heel end, comprising:

a switch machine located on the field side of said running rail;

a point end switch rod assembly connected to the point ends of said pair of movable rails, and comprising a point end switch rod housed in a first hollow tie;

a heel end switch rod connected to the heel ends of said pair of movable rails, said heel end switch rod being housed in a second hollow tie;

a rear basket associated with said heel end switch rod for controlling the throw applied to said heel end switch rod wherein said rear basket is at least partially housed in a portion of said second hollow tie;

an assist rod assembly extending between said portion of said second hollow tie and said front end switch rod assembly, said rear basket being operatively connected to said assist rod assembly such that said assist rod actuates movement of said rear basket; and wherein said rear basket is located on the field side of said running rail.

11. The switch assembly of claim 10 wherein said assist rod assembly is adapted to undergo rotation.

12. The assembly of claim 11 wherein said rear basket is mounted on a connector rod and said connector rod is hinged to said heel end switch rod.

13. The assembly of claim 12 wherein said rear basket comprises at least one torsion arm extending between said assist rod assembly and said rear basket.

14. The assembly of claim 13 wherein a first end of said torsion arm is rigidly associated with said assist rod assembly and a second end of said torsion arm is hinged to said rear basket.

* * * * *